United States Patent [19]

Andersson

[11] Patent Number: 4,828,138

[45] Date of Patent: May 9, 1989

[54] CONTAINER WITH AN OPENING DEVICE

[75] Inventor: Per M. Andersson, Lutry, Switzerland

[73] Assignee: Tetra Pak Finance & Trading S.A., Pully, Switzerland

[21] Appl. No.: 207,332

[22] Filed: Jun. 15, 1988

[30] Foreign Application Priority Data

Jun. 17, 1987 [CH] Switzerland ..... 02288/87

[51] Int. Cl.[4] ..... B65D 31/00; B65D 33/00

[52] U.S. Cl. ..... 220/272; 220/270

[58] Field of Search ..... 220/270, 271, 272, 273, 220/260, 359

[56] References Cited

U.S. PATENT DOCUMENTS 3,302,824 2/1967 Cheeley ..... 220/272
3,404,799 10/1968 McNamara ..... 220/272
3,884,382 5/1975 Ball ..... 220/272
4,501,375 2/1985 Katsura et al. ..... 220/270

*Primary Examiner*—George T. Hall
*Attorney, Agent, or Firm*—Michael L. Dunn

[57] ABSTRACT

A container having a top wall being made at least partly of a support material and being coated. The container has an opening device with a puncture line, along which the pouring spout can be torn open. The improved pouring spout having an improved impermeability to gases of the container, and according to the invention having at least at one location of the puncture line a grip means and a tear-off means made of plastic being attached inside and outside to the support material. The tear-off means is preferably molded into a hole in the top wall to have a cross-sectionally rivet-like shape and has a grip means.

13 Claims, 2 Drawing Sheets

Fig.1
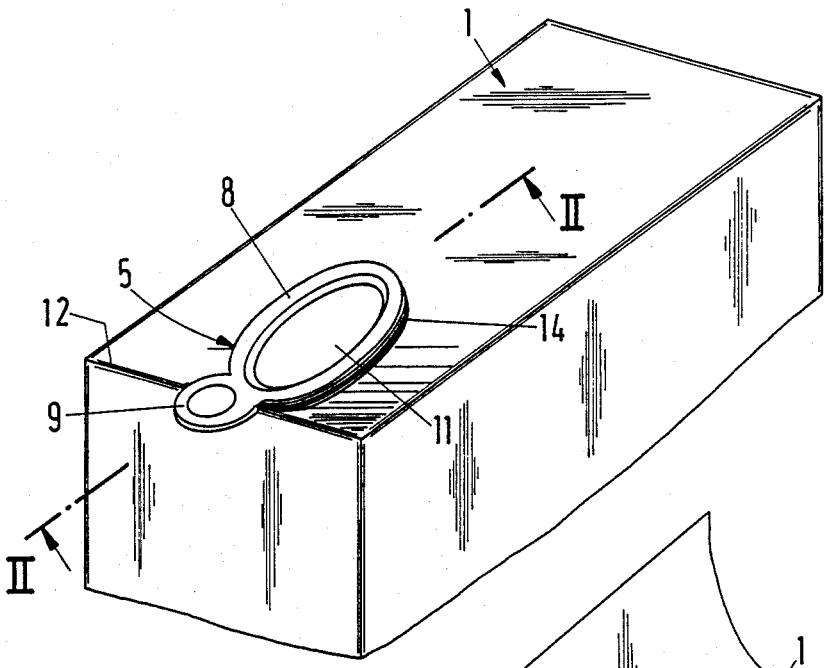
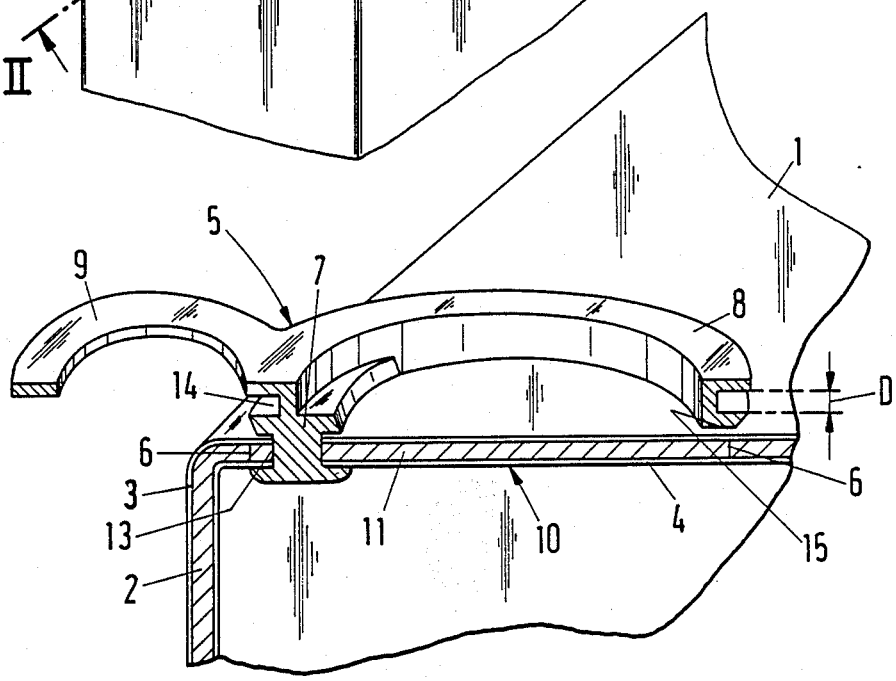
Fig.2

Fig.3
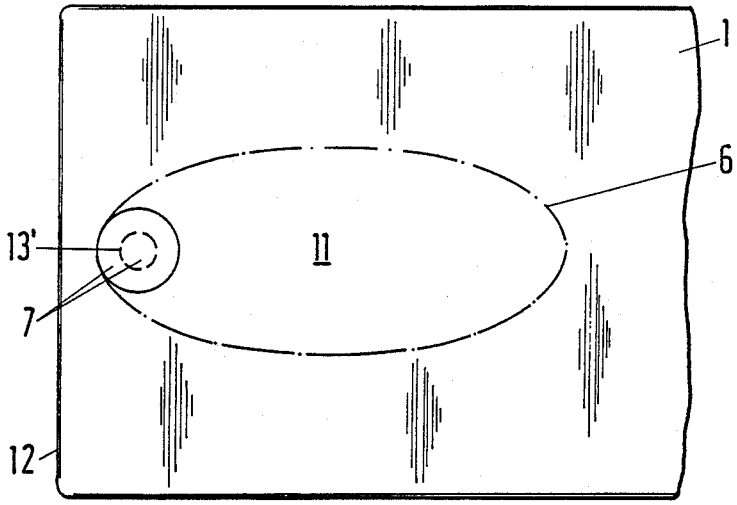
Fig.4
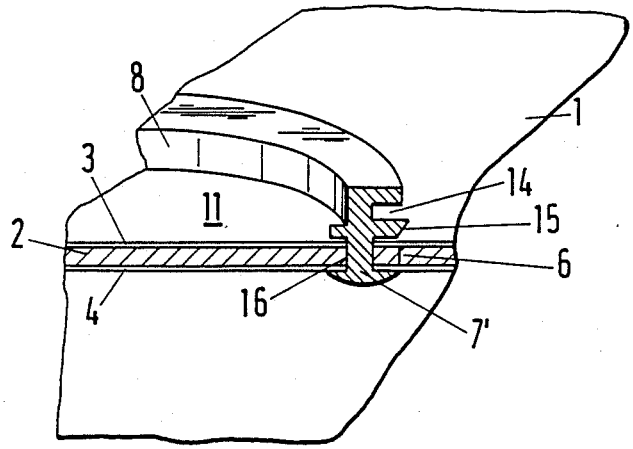
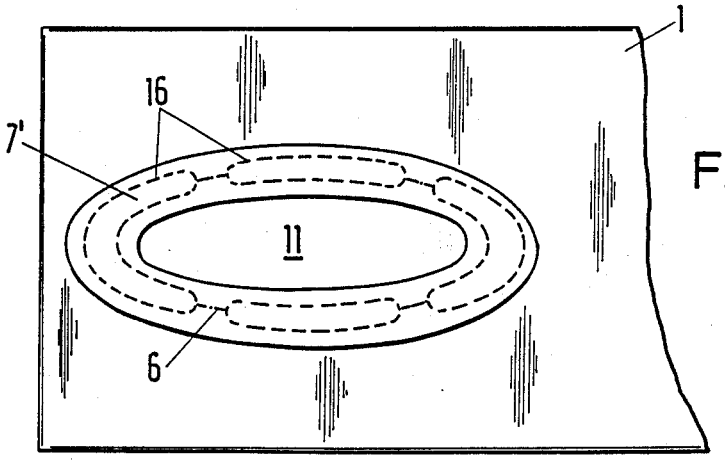
Fig.5

CONTAINER WITH AN OPENING DEVICE

BACKGROUND OF THE INVENTION

Containers are in most cases manufactured and used as throwaway containers, mostly for liquids.

Milk containers are known which are made of paper or cardboard as support material and which are coated with plastic on both sides. In the top wall of the known containers a puncture line is arranged which extends in the paper itself, but does not intrude into either of the plastic layers on one or the other side, particularly on the inner face of the packing, so that when the packaged material is a liquid, the latter cannot penetrate into the paper at the incision spots and thus destroy the container. The container is thus fluidtight in spite of the provision of the puncture line. The puncture line delineates a pouring spout which, in some containers, is arranged in a double-walled triangular flap and in other containers is arranged directly in the top surface of the container, so that the liquid can be poured out easily once the pouring spout has been torn up along the puncture line, thus freeing its orifice.

SUMMARY OF THE INVENTION

The invention includes a container with a top wall which consists at least partly of a support material. The support material is coated with a plastic material on both sides, and has an opening device with a puncture line along which the pouring spout can be torn open, a grip means on at least one location of the puncture line and a tearing device attached to the support material of the container.

BRIEF DESCRIPTION OF THE DRAWINGS

Advantages, features and possibilities of application of the present invention will be apparent from the following description of preferred forms of embodiment, with reference to the drawings in which:

FIG. 1 is a fragmented perspective plan view of the top wall of a closed container, with the opening ddevice according to the invention;

FIG. 2 is a perspective, partly sectional and fragmented view through the basic form of FIG. 1, taken along the line II—II on an enlarged scale;

FIG. 3 shows the top wall of FIG. 2 as viewed from inside the container, again fragmented on the right-hand side;

FIG. 4 is a view similar to that of FIG. 2, but in another form of embodiment in which the ring-shaped web is likewise of a cross-sectionally rivet-shaped construction; and FIG. 5 is a view similar to that of FIG. 3, but illustrates yet another form of embodiment similar to that of FIG. 4.

DETAILED DESCRIPTION OF THE INVENTION

All the forms of embodiment illustrated in the figures of the drawing relate to a liquid container with a top wall 1, which comprises a support material 2, for eample cardboard or paper, which on its outer container face is provided with a plastic coating 3 and on the inner container face is provided with a plastic coating 4.

The top wall 1 is provided with an opening device, generally referenced 5. The opening device 5 has a puncture line 6 (illustrated with composite lines in FIGS. 3 and 5) which is visible in cross-section in FIGS. 2 and 4 as well. Along this puncture line 6, which in this case is a closed oval line, is arranged the tear-off device 7, rivet-shaped in accordance with the form of embodiment of FIGS. 2 and 3 with a formed-on web 8 and grip means 9; and, according to the form of embodiment of FIGS. 4 and 5, with a cross-sectionally rivet-shaped web 7'.

Lastly, by the puncture line 6 is formed the pouring orifice 10, which corresponds to the tear-off portion 11 of the top wall (within the puncture line 6).

In the form of embodiment of FIGS. 2 and 3, the rivet-shaped tearing device 7 is situated in the location referenced 13 in FIG. 2 which is laying closest to the lateral edge 12 of the container and forms the spout tip. Accordingly, there is formed a practically circular hole 13', shown in FIG. 3 by a broken line. The hole 13' is located, as is the spatially rivet-shaped tearing means 7, within the puncture line 6, that is to say, within the tear-off portion 11 of the top wall From this location 13 of the rivet shape of the tearing device 7 extends the annular web 8, which, according to the illustration of FIG. 2, is merely cemented above on the outer plastic layer 3 of the top wall 1. The lower outer edge of the ring-shaped web 8 is flush with the puncture line 6, as can be seen in the right-hand part of FIG. 2. In addition, the ring-shaped web 8 has the outwardly open groove 14 arranged outside radially relative to the pouring orifice 10, which groove extends in the form of a complete circle. The thickness D of the groove 14 (right-hand side of FIG. 2) is greater relative to the paper layer 2, inclusive of the plastic layers 3 and 4. On the underside, both the web 8 at the location 15 as well as the oppositely located rivet-like tearing device 7 have a wedge-shaped bevelled portion for the purpose of improved re-sealing.

In the view presented in FIG. 3, the presentation is in the direction of the top wall from the inside of the container, allowing to recognize as drawn in full line the outer contour of the rivet-shaped tearing device 7, whilst the hole is illustrated by the circle 13, drawn in broken line, and the puncture line is represented by the composite line 6.

In the form of embodiment according to FIGS. 4 and 5, the cross-section of the ring 8 also has a rivet-shaped structure 7', but not along the entire puncture line 6, beside which otherwise an oval elongated slot 16 is partly present, it is interrupted at four points according to FIG. 5, where the puncture line 6 drawn in composite line can be seen. Like FIG. 3, FIG. 5 is a view on the top wall 1 from inside the container in the still unopened state. In FIG. 5, in the second form of embodiment, the two parallel, oval-shaped continuous lines of the mushroom-shaped bead of the rivet-like tearing device 7' oriented towards the inside of the container, but which is connected with the upper ring web 8 only through the longitudinal slots 16. The tear-off part 11 of the top wall is connected with the outer part of the top wall through the four previously mentioned portions where the puncture line 6 can be seen.

In accordance with the invention, at least at one location of the puncture line 6 a grip means 9 and a tear-off means 7 made of plastic is attached inside and outside on the support material 2. By the use of plastics for the grip means 9 and tear-off means 7, the latter can be advantageously molded in any desired shape, so that by means of the device according to the invention the tearing-open and opening of the pouring spout can in particular be improved to the effect that the forces exerted by the user are directed to the correct location, so that the tearing process is guaranteed to be initiated in the puncture line 6. Also of importance is the location of the tearing device 7 on both the inner and outer face of the support material 2 (though the grip means 9 is, of course, arranged only on the outside of the container). According to the engagement of the support material 2 internally by the tearing device 7, that is to say, from the outside of the container and, additionally, from the inside of the container, the tearing force exerted by the user is directed completely to the support material 2 in the region of the tearing device 7, so that the tearing effect starts securely along the puncture line 6 and is effected along this line, because, as in the known containers, the tearing effect should take place along the puncture line and not accidentally to one side of it. As known, the initiation of the tear is of particular importance, and this is achieved particularly advantageously with the novel grip means 9 and tear-off means 7 according to the invention.

However, the devices according to the invention also bring the further advantage that a container fitted with such an opening device 5 is better suited for aseptic conditions, because it is impermeable to gases to a substantially greater extent, being in particular impermeable to oxygen, than the hitherto known containers or constructions still in the development stage. In this context, it has been proposed to construct containers with a top wall consisting entirely of a plastic without a support material, in which an opening device of any desired form can be arranged by injection molding. Such containers can indeed be manufactured very easily, simply and economically and used for liquids which need not be packed and stored under aseptic conditions; however, if the sterility of the packed material is to be ensured, then there arises the drawback of a certain permeability to gases of the plastic lid (with the opening device).

In accordance with the invention, the top wall I can, for example, be made of a support material 2 additionally lined with a metal foil (e.g. of aluminum), which has only at one or more small spots, a stopper-like element made of plastic. Since these stoppers can be made very small relative to the surface area of the top wall and are thick in addition, such a top wall, although it has a practical and easily operable opening device, it can be manufactured to be substantially impermeable to gases.

According to the invention it is particularly expedient when the tear-off device 7 is molded into a hole in the top wall 1 so as to have a cross-sectionally rivet-like shape and a molded-on web, ring, grip or the like. Grip means for opening devices in liquid packs are known in large numbers per se. Grip means in a multiplicity of shapes can be provided most expediently if they can be produced by injection molding and the like and consist of a synthetic plastic material, as is provided in the case of the present invention. More important, however, is the tear-off means, which can preferably be injection-molded in one piece with the grip means. The tear-off element reaches through the top wall through a hole through which, during the injection molding, the plastic material can flow from one side of the top wall in the mold space to its other side. The hollow spaces in the individual molding part of the die are so conformed, that the tear-off element, viewed cross-sectionally, overlaps mushroom-shaped the edges of the hole and has the aspect of a rivet. If the user seizes the grip means and for opening the opening device directs a force on the tear-off means, then the rivet-like shaping of the tear-off means effects, that the tearing forces are directed to the edge of the hole in the top wall and from there into the puncture line which, according to the invention, is expediently arranged at a small distance beside an edge of the hole. The new tear-off means thus provides for a secure and good grip on the paper or other support material which is to be torn up so that the pouring spout is formed, so that the opening is guaranteed to the user under all circumstances; and this without any additional tools such as knives or scissors.

In an advantageous further development of the invention, the point of attachment of the tear-off means on the top aall of the container is the spout tip of the pouring-out orifice. By this means, it is advantageously ensured that the start of the tear-off process commences at the spout tip of the pouring orifice, that is to say, at a point where the stream of liquid will assuredly flow out when poured. This eliminates frustrating errors occurring on opening of known containers, wherein a tear occurs at the wrong points, so that in some cases the discharge of the contents is considerably restricted.

A preferred form of embodiment of the invention is furthermore characterized in that the hole in the top wall of the container and the tear-off means 7 are arranged within the pouring spout delineated by puncture line 6 in the tear-up portion 11 of the top wall 1. The molded-in plastic parts should at least partly overlap the support material 2 on the inside and on the outside, in order to provide for a good anchoring between the tear-off means 7 and the support material 2. This results in bead-shaped portions which, in an advantageous manner, owing to the just-mentioned devices according to the invention, remain in that part which is torn up or torn off and forms the pouring spout. More particularly, this avoids the presence of bead portions on the spout tip, so that nothing interferes with a faultless discharge of the contents.

However, in addition to the good pouring features and the previously mentioned advantages, yet another advantage can be achieved according to the invention if a particularly preferred form of embodiment is so constructed that, according to the invention, the tear-off means 7 has on the outside of the container a groove 14 extending radially relative to the pouring orifice and at least partly along the puncture line 6. This advantage consists in the provision of the groove, that the thickness of the support material (thickness of paper) fits well into the groove 14. Following the tearing-up of the opening with the aid of the tear-off means 7 according to the invention and after partial emptying of the container, the user often desires to close the container again as tightly as possible. According to its construction of a synthetic plastic material and the other previously mentioned features and devices, the tear-off device 7 according to the invention makes it possible to effect the provision of the groove 14 in a simple manner and in any desired structure; thus also in the manner whereby the torn-up or torn-off part 11 (to form the pouring orifice), after the partial emptying of the container, is folded back into the pouring orifice or laid upon or pressed into the latter in a manner generally known to the end-user, so that the paper passes into the groove, so that the closure is maintained and the opening device is closed.

It is particularly advantageous if the web underneath the groove has a wedge-shaped face in the direction of the top wall 1 of the container, so that the pressing-in or inserting of the partly torn-off piece with the tear-off element into the hole is well executed and the closure can be anchored by a snapping-in movement.

Furthermore, according to another preferred form of embodiment, the invention is so conceived, that the tear-off device 7 has the form of a rivet 7' and has on the latter, located on the outside of the top wall, a web which extends at least partly along as well as inside the puncture line 6 in the tear-up portion of the top wall 1 of the container and has a resealing groove 14 which is open in outward direction and is arranged on the outside radially relative to the pouring orifice.

In the above-described preferred form of embodiment, the tear-off means 7 is constructed so as to have a rivet shape cross-sectionally 7', but a three-dimensional rivet form, that is to say, the hole is preferably circular so that the tear-off device passes like a rivet through the hole from the outside to the inside (relative to the container), overlaps the edge of the hole on both sides in the form of a mushroom and thus directs the forces initiated on tearing open of the orifice to the desired location, especially at the beginning of the tearing operation, in particular directly to the puncture line arranged directly beside the tear-up line. Due to the web which is formed onto the rivet-shaped tearing device, the force is at least partly conducted further along the puncture line, even though in this region of the web the top wall is not seized from the interior of the container and torn upwards by means of the web. Nor is this necessary in general, because the puncture line conducts the tearing-up force.

In the last-mentioned form of embodiment, the re-sealing is particularly well promoted, because the tearing device can concentrate itself on a knob-like or rivet like area on the puncture line, while the groove, for re-sealing purposes, nevertheless extends over the entire periphery of the pouring orifice, in particular by means of the web which on the outside has the aforedescribed groove. It is obvious, that the web-like part underneath the groove, that is to say, beside the surface of the top wall, can likewise be internally bevelled to facilitate the re-sealing and guiding of the torn-up or optionally torn-out closure.

Also noteworthy is the further advantage whereby, even in the case of an annularly shaped web, that part of the support material which can be torn up remains suspended from this web in the top wall within the puncture line, so that both the opening and re-sealing operations are considerably facilitated. The resealing by means of such a tearing device with rivet and web can be achieved even with substantially dust-proof effect.

It is further advantageous according to the invention if the puncture line in the top wall of the container closes in itself, the web has the form of a ring adapted to the contour of the puncture line and if the ring also has an at least partly rivet-like cross-sectional shape. Here, in difference of the previously described form of embodiment of the invention, the tearing device is not restricted to a knob or rivet-like portion, but, in the form of embodiment here provided, at least a part of the ring has a cross-sectionally rivet-shaped construction, so that at least on this part of the ring the pouring orifice will be formed by a tearing-out operation and the forces are conducted over the ring-like web directly to the puncture line. Here, the puncture line can be circular, oval-shaped or polygonal or the like, where, preferably, again the tip of the pouring spout is arranged as closely as possible to an edge of the top wall of the container.

It is also conceivable, as viewed on the lower face of the container top wall, that is to say, viewed from the inside, to give the web a U-shape, so that the pouring orifice is formed only by tearing-up and the torn-up part of the top wall remains attached to the top wall. In yet another form of embodiment, when the puncture line closes in itself, the pouring orifice can be completely torn up, that is to say, that portion of the top wall of the container which is located within the puncture line is completely torn off and can be laid separately next to the container. In spite of this, a resealing can be achieved in a simple and advantageous manne, as previously described.

Also conceivable is a form of embodiment, in which the web, over the whole of its extent along the puncture line (U-shaped or circular), with the exception of one to four locations to be spaced relative to each other, penetrates through the top wall by way of slits extending beside the puncture line and in each location overlaps with mushroom-like cross-section on both sides (outside and inside the container). In such a form of embodiment, the tear-up or tear-off forces will be conducted from the grip means to the tear-off means and with the exception of the few overlap points of the paper or support material are guided directly from the web beside the puncture line and lastly into the latter. This guarantees a tearing-up precisely along the puncture line, without having to renounce the other, above mentioned advantages to any substantial extent.

While the present invention has been disclosed in connection with the preferred embodiment thereof, it should be understood that there may be other embodiments which will be apparent to the skilled in the art from a consideration of this specification and which fall within the spirit and scope of the invention as defined by the following claims.

What is claimed is:

1. A container comprising:

a top wall, being made at least partly of a support material, said support material having an inside face and an outside face, said faces being coated with a plastic material;

an opening device on said top wall, said opening device having a puncture line along which a portion of the top wall may be torn off to form a pouring orifice;

a grip means on at least one location of said puncture line; and a tearing device attached to the support material of the container and having at least one part of said tearing device on the outside face of the support material and one part of said tearing device on the inside face of the support material.

2. The container of claim 1 wherein the tearing device is molded into a hole in the top wall, said tearing device being cross sectionally rivet-shaped.

3. The container of claim 1 wherein the grip means is a molded-in web.

4. The container of claim 1 wherein the grip means is a ring.

5. The container of claim 1 where in the grip means is a grip.

6. The container of claim 1 wherein the tearing device, located on the top wall of the container forms a spout tip of the pouring orifice.

7. The container of claim 1 wherein the tearing device molded into a hole in the top wall is arranged within the pouring orifice, said pouring orifice being delineated bythe puncture line of a tear-off part of the top wall.

8. The container of claim 1 wherein the tearing device, on the outside face of the top wall of the container, further comprises, a radial groove located at least partly along the puncture line for the purpose of re-sealing the pouring orifice.

9. The container of claim 2 wherein the tearing device further comprises an externally attached web, said web extending at least partly along and inside the circumference of the puncture line and secured to the tear-off portion of the top wall of the container, said tearing device having an exterior circumferential groove sized and arranged to permit re-sealing of the orifice.

10. The container of claim 9 wherein the puncture line in the top wall of the container is a closed loop line, the web having the form of a ring adapted to the contours of the puncture line, said ring having an at least partly rivet-shaped cross-sectional form.

11. The container of claim 10 wherein the puncture line is a closed oval line.

12. A container comprising:

a top wall, being made at least partly of a support material, said support material having an inside face and an outside face, at least one of said faces being coated with a metal foil;

an opening device on said top wall, said opening device having a puncture line along which a pouring orifice can be torn open;

a grip means on at least one location of said puncture line; and a tearing device attached to the support material of the container and having at least one part of said tearing device on the outside face of the support material and one part of said tearing device on the inside face of the support material.

13. The container of claim 12 wherein the metal foil is aluminum.

* * * * *